US006712094B1

(12) United States Patent
Chen

(10) Patent No.: US 6,712,094 B1
(45) Date of Patent: Mar. 30, 2004

(54) CONNECTION STRUCTURE FOR FAUCET WATER DISCHARGE TUBE AND FAUCET BODY

(76) Inventor: Wen Pin Chen, No. 120-7, Lane Liau Tsuo, Liau Tsuo Li, Lu Kang Chen, Changhua (TW)

( * ) Notice: Subject to any disclaimer, the term of this patent is extended or adjusted under 35 U.S.C. 154(b) by 43 days.

(21) Appl. No.: 10/245,685

(22) Filed: Sep. 18, 2002

(51) Int. Cl.[7] ..... E03C 1/04
(52) U.S. Cl. ..... 137/801; 4/678; 285/208
(58) Field of Search ..... 4/678; 137/801; 285/191, 193, 207, 208, 213, 220

(56) References Cited

U.S. PATENT DOCUMENTS 2,973,976 A * 3/1961 Steinen ..... 285/220
3,880,183 A * 4/1975 Humpert et al. ..... 4/678

* cited by examiner

*Primary Examiner*—Gerald A. Michalsky
(74) *Attorney, Agent, or Firm*—Rosenberg, Klein & Lee

(57) ABSTRACT

A connection structure for faucet water discharge tube and faucet body and particularly an improved connection structure to resolve the problems of connecting the water discharge tube by soldering that occur to modern faucets. The faucet body has a two-step opening formed on the inner wall to couple with an outer screw coupling tube. The outer screw coupling tube is extended outside the faucet body to couple with screw threads formed on the inner wall of a water discharge tube to form a passage inside the faucet body and the water discharge tube. Assembly can be accomplished rapidly and the connection juncture is smooth. Difficult polishing process can be eliminated. Pores and defective soldering occurred in the soldering process decrease, and loss resulting from defective products is lower. Production cost can be greatly reduced and the aesthetic appeal of finished products increases.

2 Claims, 5 Drawing Sheets

CONNECTION STRUCTURE FOR FAUCET WATER DISCHARGE TUBE AND FAUCET BODY

BACKGROUND OF THE INVENTION

1. Field of the Invention

The invention relates to a connection structure for faucet water discharge tube and faucet body, and particularly an improved connection structure to resolve the problems of connecting the water discharge tube by soldering that occur to modern faucets.

2. Description of the Prior Art

Conventional faucets generally are made by casting. Because of the constraint of casting molds, the shapes of the faucets are limited. Moreover, casting process creates a lot of environmental problems. In recent years the growing awareness of exterior design has made conventional faucets losing their appeal in the market place. Faucet producers have been trying to focus more creative designs to meet more demanding market requirements. The mainstream of this trend is to target the shape of the faucet body and the water discharge tube. FIG. 1 illustrates a typical example. However the connection of the faucet body 10 and the water discharge tube 11 generally is done by soldering on the connection juncture as shown in FIG. 2. In such a structure, the spout 12 of the faucet body 10 communicates with the water discharge tube 11 to form a passage. However such a connection method has the following disadvantages:

1. The connection juncture of the faucet body 10 and the water discharge tube 11 includes three dimensional curved lines. It has dead angles. Thus the polishing process becomes very difficult. The cost is higher. And exterior quality after polishing does not always meet aesthetic requirements.
2. Soldering process unavoidably produces pores and cavities, or defective soldering spots. The pores and cavities will cause water leaking or seeping problems. The defective soldering spots could result in not secured connection and tend to break or rupture when subject to impact.
3. Soldering process generates waste gases and high temperature. It could cause harmful effects or professional illness to working people.

Therefore how to overcome the problems incurred to soldering of the faucet and to develop an improved connection structure for faucets are the main focus of the present invention.

SUMMARY OF THE INVENTION

The primary object of the invention is to provide a connection structure for faucet water discharge tube and faucet body that is accomplished by fastening to eliminate the difficult polishing process and to greatly reduce fabrication costs and improve the appeal of the finished products.

Another object of the invention is to provide a connection structure for faucet water discharge tube and faucet body that is accomplished by fastening to prevent pores or defective soldering from occurring and to increase production yield and effectively reduce the loss resulting from defective products.

Yet another object of the invention is to provide a connection structure for faucet water discharge tube and faucet body that is accomplished by fastening to prevent professional illness or injury caused by high temperature and waste gases resulting from the soldering process.

In order to achieve the foregoing objects, the invention has a two-step opening formed on an inner wall of the faucet body to couple with an outer screw coupling duct which has a flange ring formed on one end. The outer screw coupling duct further couples with a seal ring on a neck adjacent to the inner side of the flange ring. The outer screw coupling duct is inserted into the two-step opening from the interior of the faucet body and to enable the flange ring to engage with the two-step opening to form a watertight coupling. There is a water discharge tube which has an inner wall coupled with a coupling bushing that has external screw threads. The coupling bushing has internal screw threads to couple with an outer screw section of the outer screw coupling duct to enable the water discharge tube to communicate with the interior of the faucet to form a passage. The faucet thus made has a smooth connection juncture.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
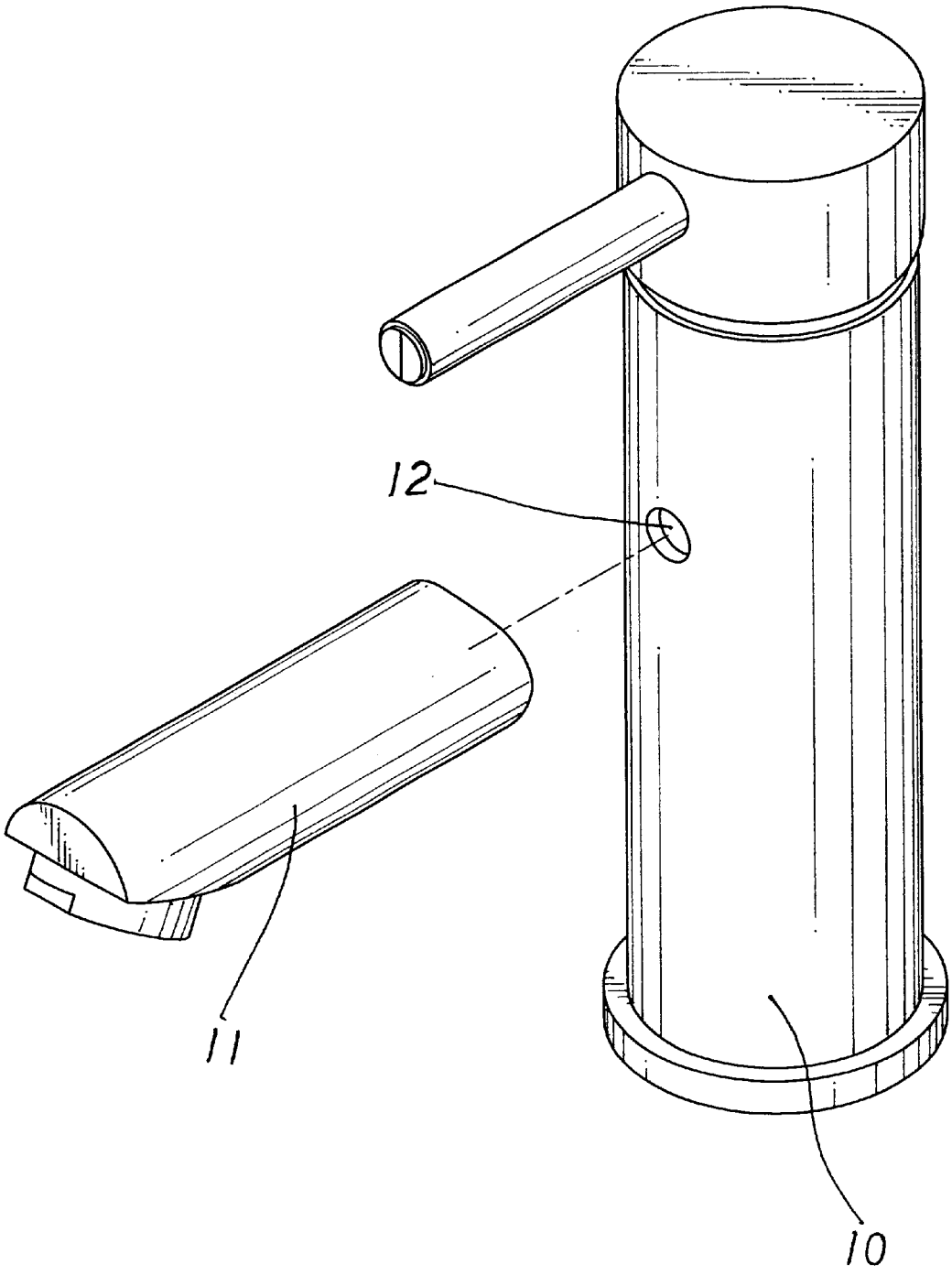
FIG. 1 PRIOR ART
FIG. 1 is a schematic perspective view of a conventional faucet water discharge tube to connect to a faucet body.
Figure 2:
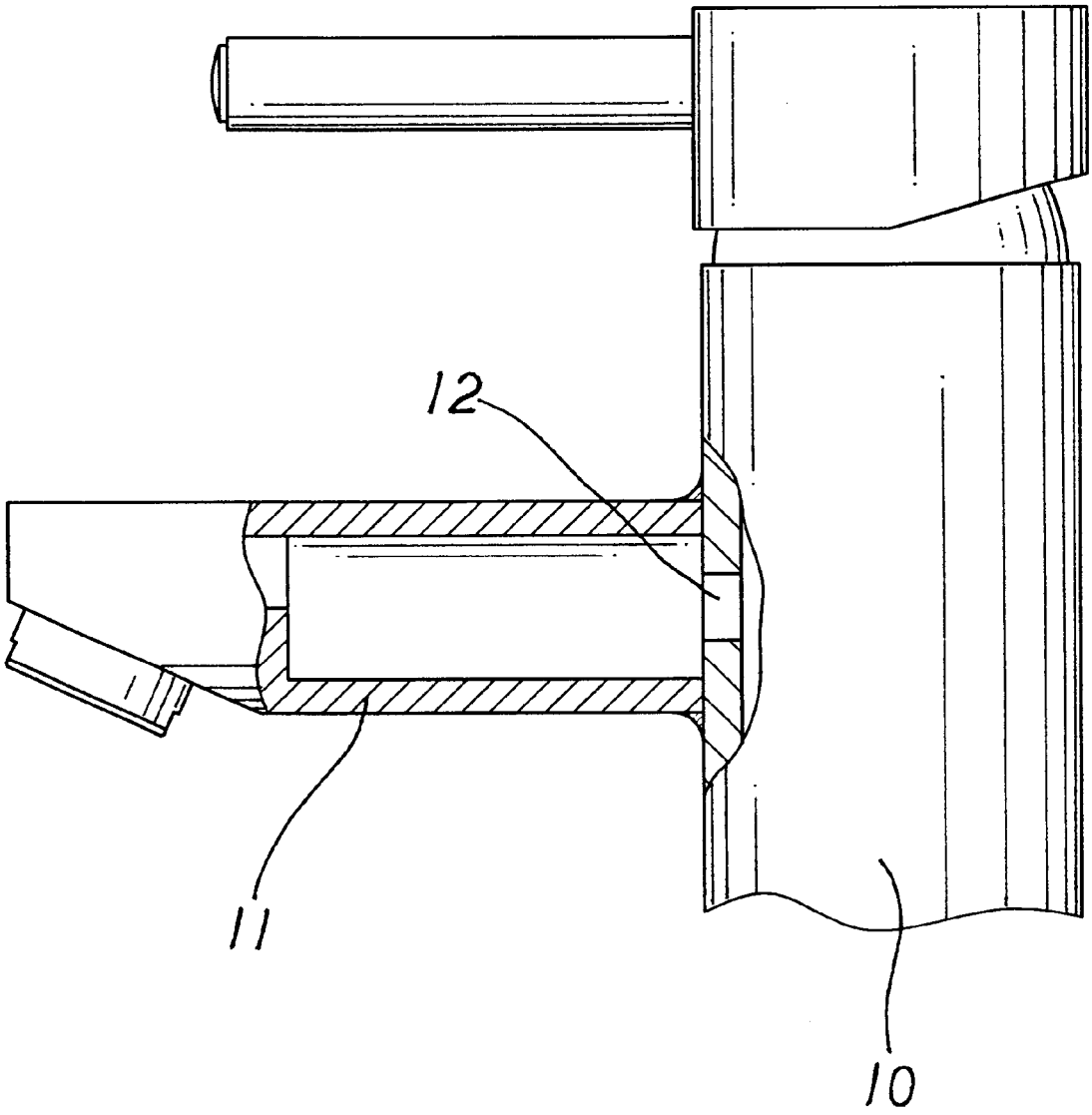
FIG. 2 PRIOR ART
FIG. 2 is a side view of a conventional faucet water discharge tube connected to a faucet body, partly cutaway.
Figure 3:
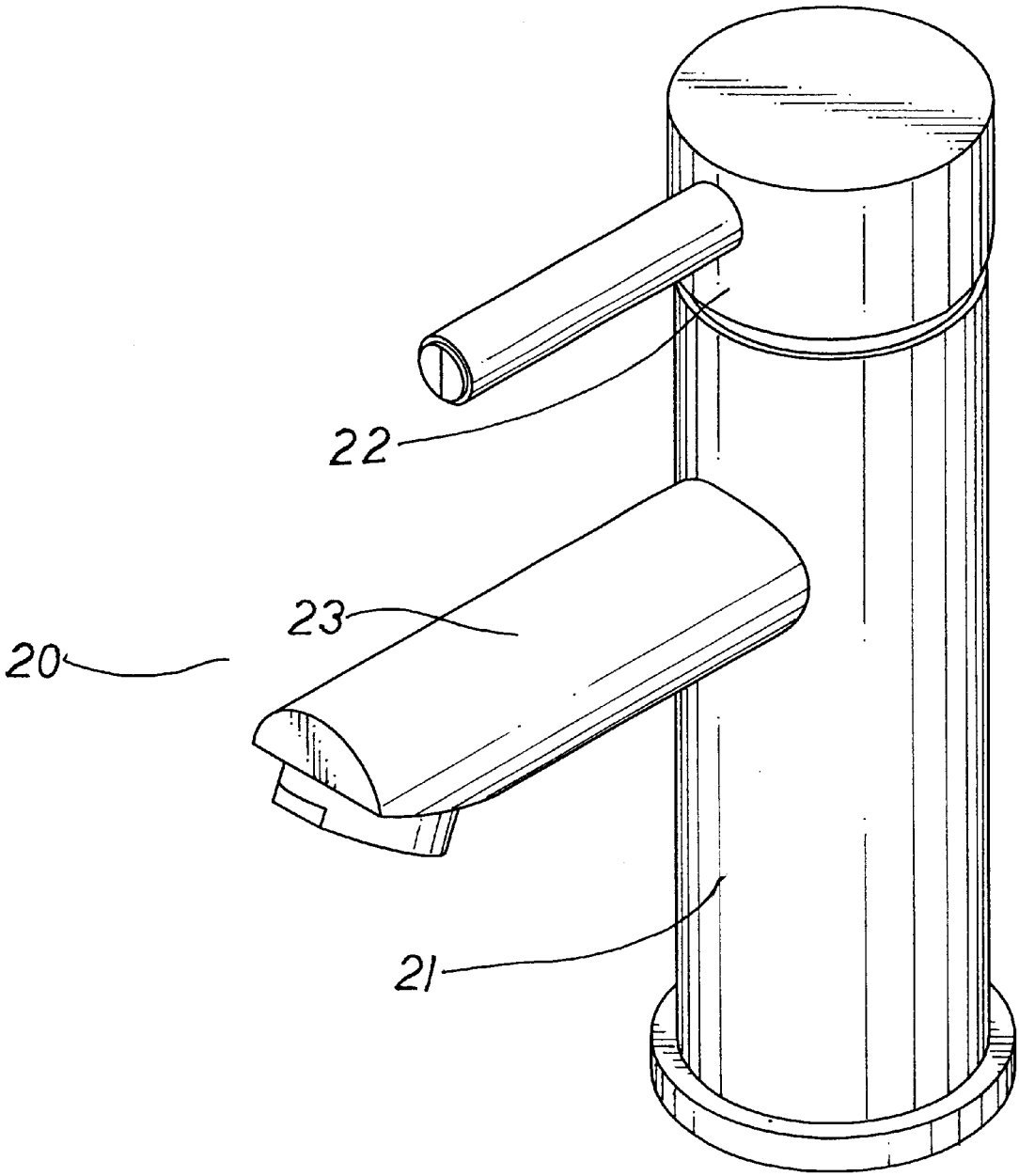
FIG. 3 is a perspective view of the invention.
Figure 4:
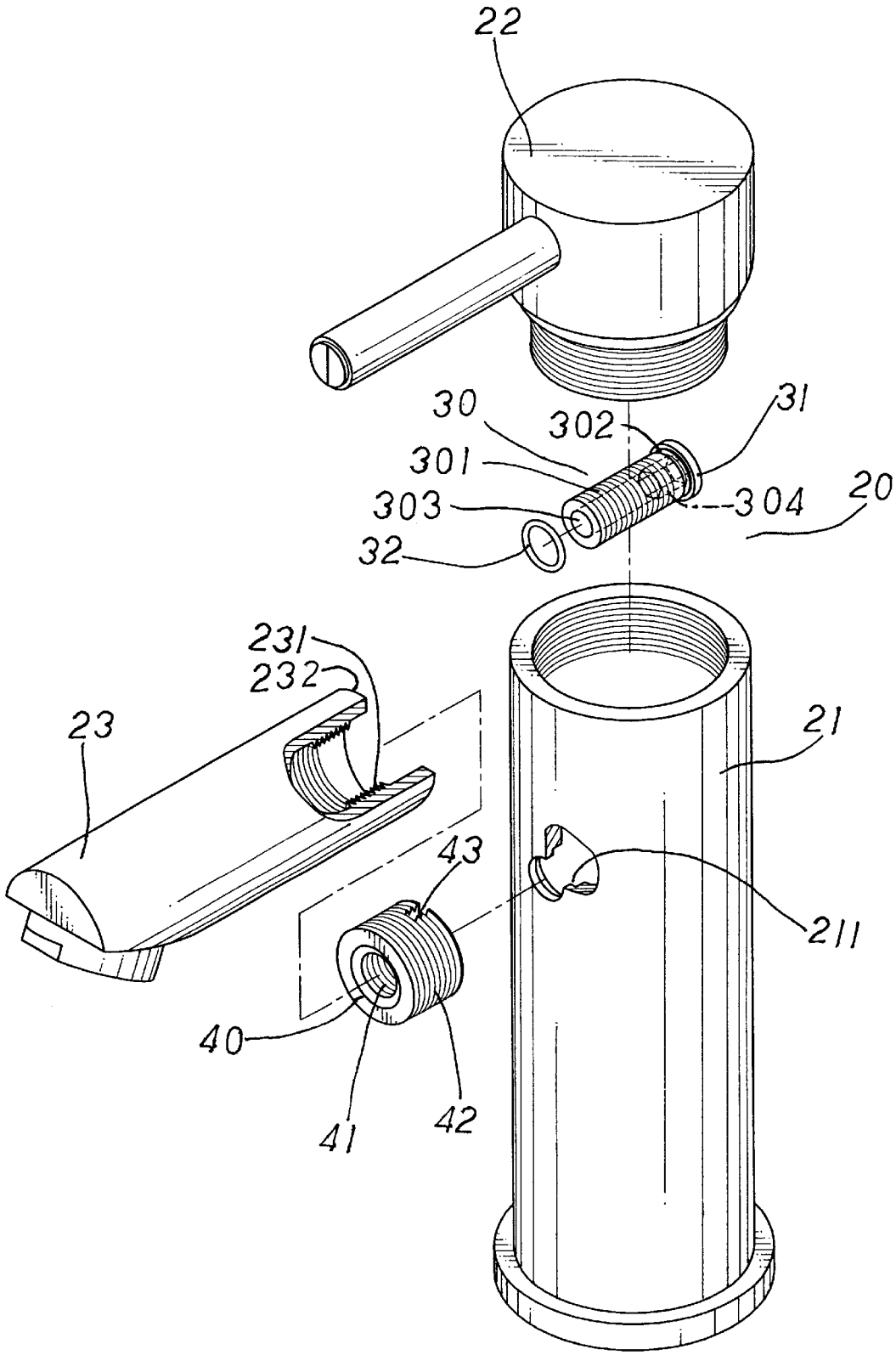
FIG. 4 is an exploded view of the invention.

Referring to FIGS. 3 and 4, the faucet 20 of the invention includes a faucet body 21 which is a hollow duct with an opening formed on the top end for coupling with a handle seat 22. On the inner wall of the faucet body 21, there is a two-step opening 211 which has one smaller inner diameter and one larger inner diameter for coupling with an outer screw coupling duct 30 and a coupling bushing 40 to engage with a water discharge tube 23; wherein:

the outer screw coupling duct 30 has an outer screw thread section 301, a flange ring 31 formed on one end thereof, a neck 302 adjacent to an inner side of the flange ring 31 to couple with a seal ring 32, and an axial through hole 303 formed therein. One end of the through hole 303 adjacent to the flange ring 31 forms a tool notch 304; and the coupling bushing 40 is a hollow sleeve which has internal screw threads 41 to couple with the outer screw thread section 301 of the outer screw coupling duct 30 and external screw threads 42 to couple with an inner screw hole 231 of the water discharge tube 23. The coupling bushing 40 has a rear end formed a radial turning notch 43 to engage with a tool for screwing the coupling bushing 40 in the inner screw hole 231 of the water discharge tube 23.

For assembling the invention, first, tightly screwing the coupling bushing 40 in the inner screw hole 231 of the water discharge tube 23 by wedging a tool in the turning notch 43 and turning the coupling bushing 40; inserting the outer screw coupling duct 30 from the interior of the faucet body 21 into the two-step opening 211 and extending the outer screw thread section 301 outside the two-step opening 211 with the contact rim 232 of water discharge tube 23 matching the corresponding connecting location of the faucet body 21, then keeping the water discharge tube 23 and the faucet body 21 stationary and putting a tool inside the faucet body

21 to wedge into the tool notch 304 of the outer screw coupling duct 30, and screwing the outer screw thread section 301 in the internal screw threads 41 of the coupling bushing 40. Thus complete the assembly of the water discharge tube 23 and the faucet body 21. The connection may be done rapidly at a lower cost. The connection juncture also is smooth and looks more appealing (as shown in FIG. 3).

Figure 5:
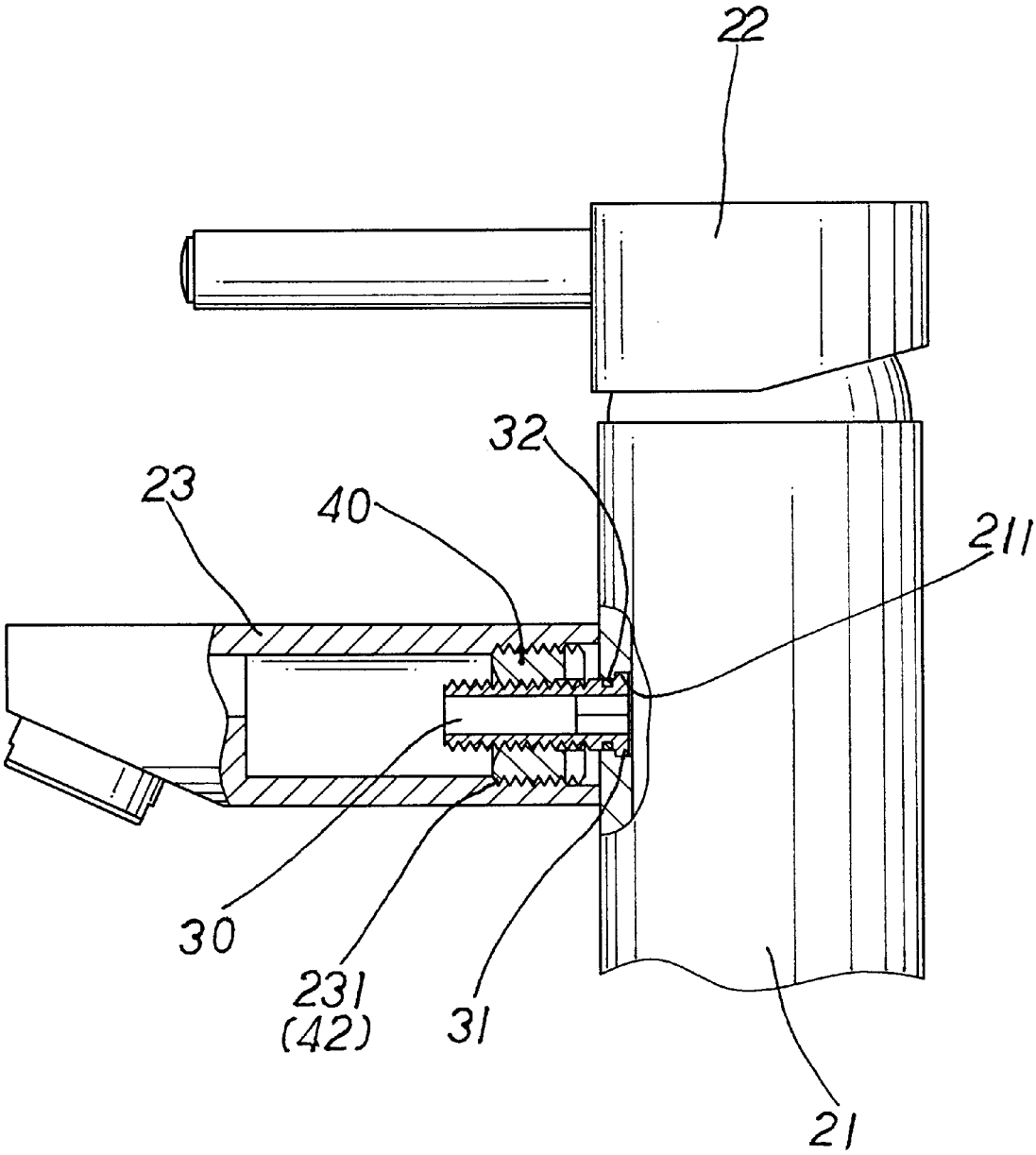
FIG. 5 is a side view of the invention, partly cutaway.

Referring to FIG. 5, the two-step opening 211 formed on the inner wall of the faucet body 21 may couple with the flange ring 31 of the outer screw coupling duct 30. The flange ring 31 and the seal ring 32 form a leak-proof combination. The outer screw thread section 301 couples with the coupling bushing 40 located in the water discharge tube 23 to form a passage.

By means of the construction and embodiment set forth above, the structure of the invention offers a simple design to enable assembly be accomplished rapidly and form a smooth connection on the outer surface. Product defects and loss can be reduced. The difficult polishing process is eliminated. Production cost is lowered and the aesthetic appeal of the finished products is enhanced.

While the preferred embodiment of the invention has been set forth for the purpose of disclosure, modifications of the disclosed embodiment of the invention as well as other embodiment thereof may occur to those skilled in the art. Accordingly, the appended claims are intended to cover all embodiments which do not depart from the spirit and scope of the invention.

I claim:

1. A connection structure for faucet water discharge tube and faucet body, comprising:

a faucet body being a hollow duct and having a top end formed an opening to couple with a handle seat and a two-step opening formed on a front side thereof, the two-step opening having a first inner diameter and a second inner diameter which is greater than the first inner diameter;

a water discharge tube having an inner screw hole;

an outer screw coupling duct having an outer screw thread section, a flange ring formed on one end thereof, a neck adjacent to an inner side of the flange ring to couple with a seal ring, and an axial through hole formed therein, the through hole having a tool notch formed on one end adjacent to the flange ring; and a coupling bushing being a hollow sleeve and having internal screw threads to couple with the outer screw thread section of the outer screw coupling duct and external screw threads to couple with the inner screw hole of the water discharge tube.

2. The connection structure of claim 1, wherein the coupling bushing has an outer end formed a radial notch to facilitate turning thereof for coupling with the water discharge tube.

* * * * *

UNITED STATES PATENT AND TRADEMARK OFFICE

CERTIFICATE OF CORRECTION

PATENT NO. : 6,712,094 B1
DATED : March 30, 2004
INVENTOR(S) : Sonnenberg et al.

It is certified that error appears in the above-identified patent and that said Letters Patent is hereby corrected as shown below:

Title page,
Item [73], Assignee, change "Forschungszentrum Julich GmbH" to -- Forschungszentrum Jülich GmbH --; and change "Frieberger Compound Materials GmbH" to -- Freiberger Compound Materials GmbH --.

Signed and Sealed this

Thirtieth Day of November, 2004

JON W. DUDAS
*Director of the United States Patent and Trademark Office*